United States Patent [19]

Malone et al.

[11] Patent Number: 4,895,327

[45] Date of Patent: Jan. 23, 1990

[54] INFANT FEEDING AID APPARATUS AND METHOD

[76] Inventors: Shirley L. Malone, 1717 Avenue A, Grand Prairie, Tex. 75051; Maxine R. Spurlock, P.O. Box 66, Venus, Tex. 76084

[21] Appl. No.: 313,052

[22] Filed: Feb. 21, 1989

[51] Int. Cl.[4] ..... A45C 9/00

[52] U.S. Cl. ..... 248/102

[58] Field of Search ..... 248/102, 105, 106, 176, 248/205.2, DIG. 10; 446/227, 901, 369, 73, 74; 5/437, 508

[56] References Cited

U.S. PATENT DOCUMENTS

| | | | |
|---|---|---|---|
| 1,287,125 | 12/1918 | Smith | 248/102 |
| 1,859,123 | 5/1932 | Ballert | 248/105 |
| 2,354,568 | 7/1944 | Allen . | |
| 2,451,718 | 10/1948 | Corrao | 248/102 |
| 2,475,923 | 7/1949 | Suich | 248/103 |
| 2,485,461 | 10/1949 | Siegel | 248/102 |
| 3,561,589 | 2/1971 | Larkin | 224/277 |
| 3,905,571 | 9/1975 | Lombardo | 248/102 |
| 4,227,270 | 10/1980 | Rivera | 248/102 |
| 4,726,551 | 2/1988 | Randall | 248/102 |
| 4,809,938 | 3/1989 | Skinner | 248/102 |

FOREIGN PATENT DOCUMENTS

| | | | |
|---|---|---|---|
| 483837 | 6/1952 | Canada | 5/437 |
| 2013508 | 8/1979 | United Kingdom | 446/901 |

*Primary Examiner*—Ramon O. Ramirez
*Assistant Examiner*—Robert A. Olson
*Attorney, Agent, or Firm*—James E. Bradley

[57] ABSTRACT

An apparatus is disclosed which aids in the feeding of an infant while the infant is placed face-up on a substantially planar feeding surface with its torso in a substantially prone position. The feeding apparatus has a center section for placement across the front of the torso of the infant during feeding. A first anchor section having two ends is coupled to the center section at one end and weighted at the opposite end for placement along one side of the torso of the infant during feeding. A second anchor section having two ends is coupled at one end to the center section opposite from and axially aligned with the first anchor section. It is weighted at the opposite end for placement along the side of the torso of the infant during feeding. The first and second anchor sections cooperate to anchor the apparatus to the feeding surface, to secure the center section in position across the front of the torso of the infant, and to minimize side-to-side movement of the apparatus, while minimizing the amount of weight placed on the infant's torso. A means is provided for securing the bottle to the center section in a position aligned with the infant's torso, within the infant's reach.

12 Claims, 2 Drawing Sheets

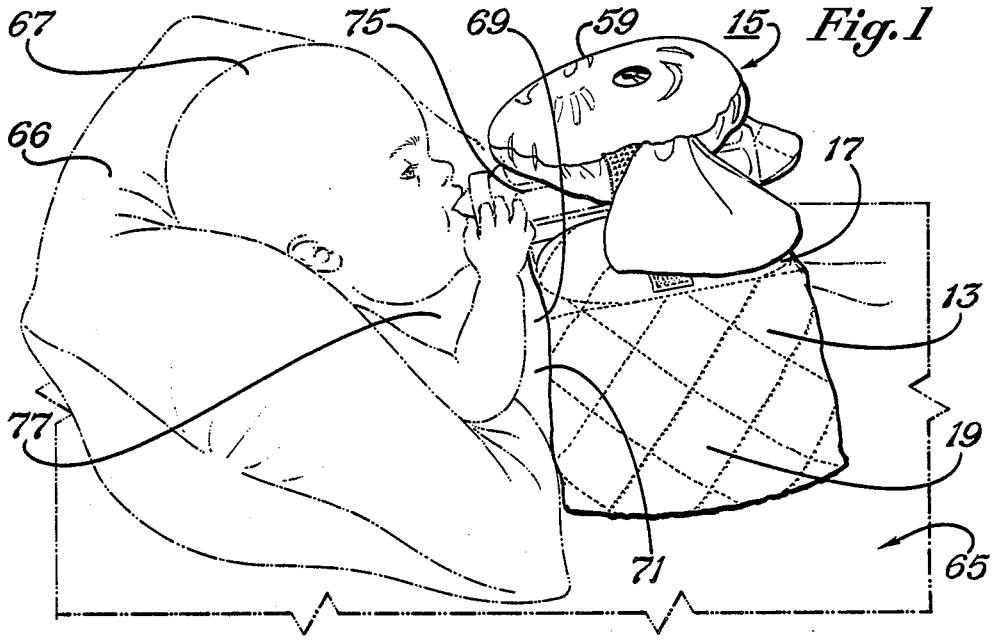
Fig. 1
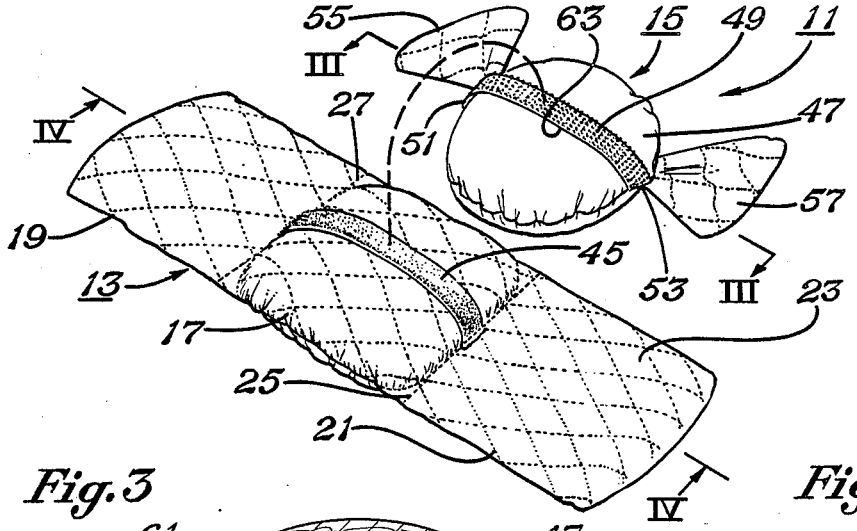
Fig. 2
Fig. 3
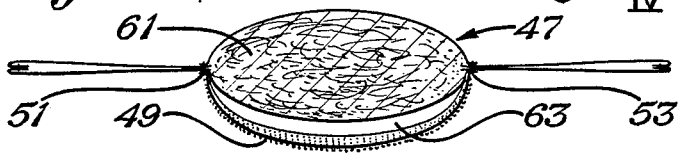
Fig. 4
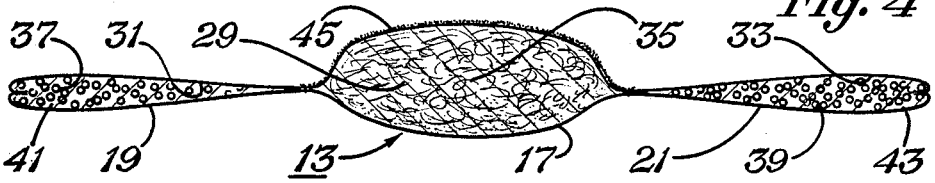

19
83
19
85
87
21
79
67

INFANT FEEDING AID APPARATUS AND METHOD

BACKGROUND OF THE INVENTION

1. Field of the Invention:

This invention relates generally to infant feeding aids, and specifically to an apparatus and method for bottle feeding an infant, and for burping the infant subsequent to feeding.

2. Description of the Prior Art:

In early infancy, much of an infant's waking time is spent feeding. It is critical to a child's growth, health, and development that it receive adequate nutrition, particularly during the early stages of its development. Once an infant has been weaned, it derives most of its nutritional intake from baby bottles filled with warm formula. However, infants usually lack the upper body strength and coordination necessary to hold a bottle in a feeding position for extended periods of time. Therefore, the bottle must be held in a position above the infant by the parent or other handler for protracted periods of time.

Bottle holding devices exist, such as the device disclosed in U.S. Pat. No. 2,354,568 entitled *Bottle Holder,* which are designed to relieve the handler of this chore, but such devices are seriously defective in several regards. First, their stability is dependent in large part upon the weight placed upon the infant's chest—achieving stability at the expense of the infant's comfort. Second, such devices tend to place the bottle out of the infant's reach, an undesirable result, since the manipulation of the bottle during feeding is one important means through which an infant develops upper body strength and coordination.

SUMMARY OF THE INVENTION

It is therefore one object of the present invention to provide a feeding apparatus which anchors the bottle in position on the infant's chest, and prevents side-to-side movement of the bottle.

It is another object of the present invention to provide a feeding apparatus which minimizes the weight placed on the infant during feeding.

It is yet another object of the present invention to provide a feeding apparatus which keeps the bottle within range of the infant and allows the infant to control the bottle to bring it forward for feeding, and rearward for resting between intervals of feeding.

It is still another object of the present invention to provide a feeding apparatus which may also function as a burping aid after feeding has been completed.

The foregoing objects are achieved as is now described. An apparatus is disclosed which aids in the feeding of an infant while the infant is placed face-up on a substantially planar feeding surface with its torso in a substantially prone position. The feeding apparatus has a center section for placement across the front of the torso of the infant during feeding. A first anchor section having two ends is coupled to the center section at one end and weighted at the opposite end for placement along one side of the torso of the infant during feeding. A second anchor section having two ends is coupled at one end to the center section opposite from and axially aligned with the first anchor section. It is weighted at the opposite end for placement along the side of the torso of the infant during feeding. The first and second anchor sections cooperate to anchor the apparatus to the feeding surface, to secure the center section in position across the front of the torso of the infant, and to minimize side-to-side movement of the apparatus, while minimizing the amount of weight placed on the infant's torso. A means is provided for securing the bottle to the center section in a position aligned with the infant's torso, within the infant's reach.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 depicts the feeding apparatus of the present invention in use and disposed about the torso of an infant;

FIG. 2 depicts the feeding apparatus of the present invention with the bottle holding portion of the apparatus detached from the base of the apparatus;

FIG. 3 is a cross-section view of the bottle holding portion of the feeding apparatus as seen along lines III—III of FIG. 2;

FIG. 4 is a cross-section view of the base of the feeding apparatus of the present invention as seen along lines IV—IV of FIG. 2.

DETAILED DESCRIPTION OF THE INVENTION

Figure 5:
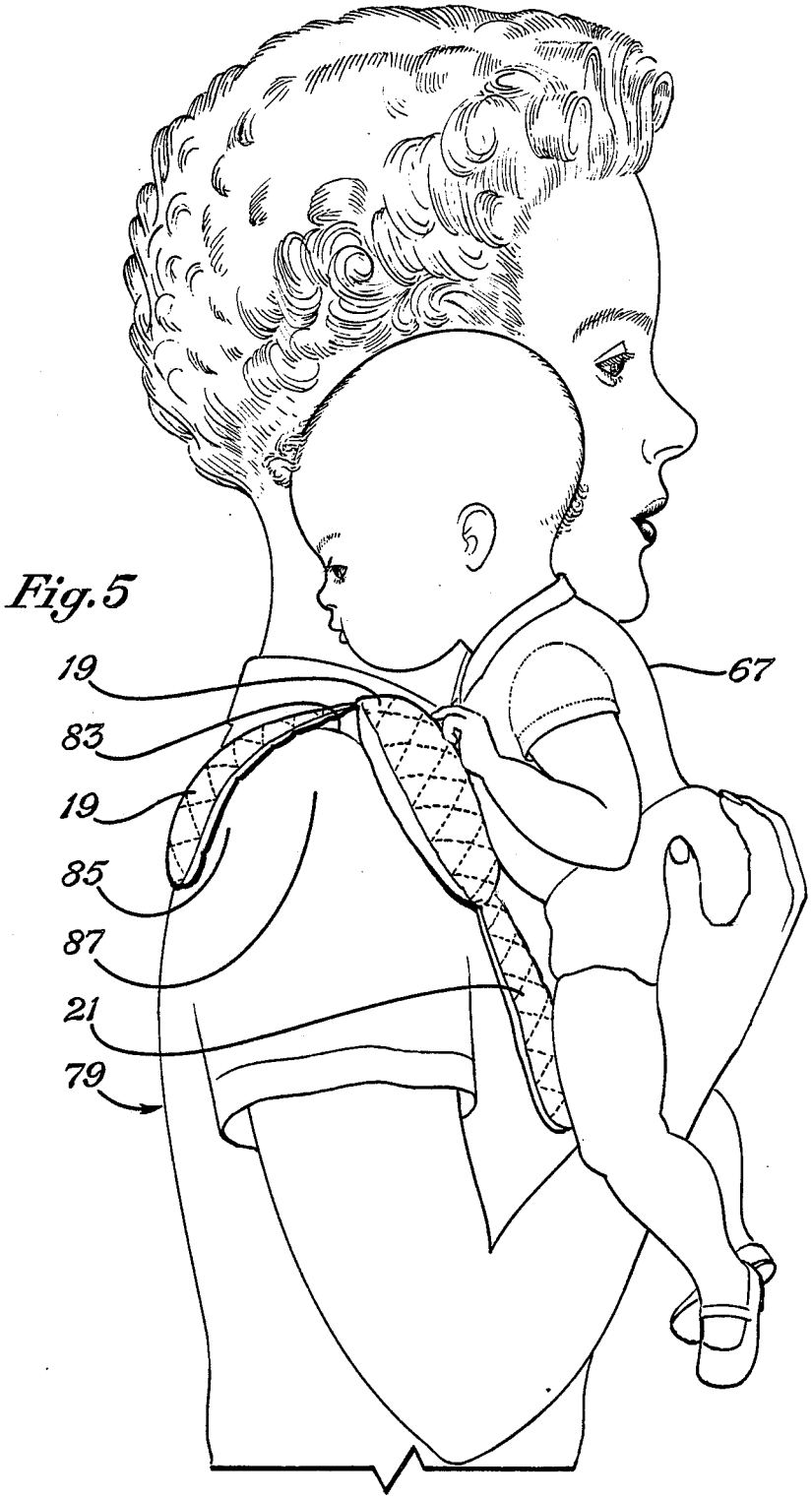
FIG. 5 depicts the feeding apparatus of the present invention in use as a burping pad.

With reference now to the figures and in particular with reference to FIG. 2, feeding apparatus 11 is depicted with base 13 separated from detachable bottle fastener 15. Base 13 includes center section 17, which is a rectangular cushion section which is filled with a lightweight compressible resilient filler material 35 and is adapted for placement across the front of the torso of an infant during feeding. A first anchor section 19 is coupled to center section 17 along edge 27. First anchor section 19 is a flexible flap which can pivot freely relative to center section 17. In addition, first anchor section 19 is relatively deformable as compared to center section 17. Second anchor section 21 is coupled to center section 17 along edge 25. Like first anchor section 19, second anchor section 21 is a flexible flap, which can pivot freely relative to center section 17 and which is deformable, as compared to center section 17. In one preferred embodiment, base 13, including center section 17, and first and second anchor sections 19, 21, are integrally formed of a waterproof fabric 23 to prevent feeding apparatus 11 from becoming damaged by fluids, such as milk from the infant's bottle.

Referring now to FIG. 4, base 13 will be described in greater detail. Compartment 29 of center section 17 is substantially filled with lightweight compressible resilient filler material 35, which serves to give center section 17 its shape and firmness. First anchor section 19 has a compartment 31 formed within it. Compartment 31 is a hollow central cavity which is filled in-part with heavy mobile particles 37, which are substantially accumulated by force of gravity at a lower region 41 of compartment 31 during feeding. Likewise, second anchor section 21 has a compartment 33 which is a hollow central cavity filled in-part with heavy mobile particles 39, which are substantially accumulated by force of gravity at a lower region 43 of compartment 33 during feeding. Mobile particles 37, 39 serve as weights which urge first and second anchor sections 19, 21 downward during feeding.

With reference again to FIG. 2, female Velcro strip 45 is secured to one face of center section 17, and cooperates with detachable bottle fastener 15 to secure a feeding bottle to feeding apparatus 11. Detachable bottle fastener 15 consists of cushion 47 having male Velcro strip 49, with first and second ends 51, 53 secured thereto. Male Velcro strip 49 is unconnected to cushion 47 between first and second ends 51, 53; therefore, a clearance is provided between male Velcro strip 49 and cushion 47. In one preferred embodiment, cushion 47 is adapted to serve as a toy for entertaining the infant during feeding; therefore, two flaps are shown secured to cushion 47, constituting ears 55, 57 of the toy.

With reference now to FIG. 3, detachable bottle fastener 15 will be further described. Cushion 47 is substantially filled with lightweight, compressible, resilient filler material 61. Male Velcro strip 49 is attached by sewing to cushion 47 at first and second ends 51, 53. A clearance 63 is provided between cushion 47 and male Velcro strip 49, and is adapted in size to accommodate a standard size bottle therebetween when filler material 61 is compressed. In use, the bottle is held in position between male Velcro strip 49 and cushion 47 by pressure from the resilient filler material 61 of cushion 47. As shown in FIG. 2, detachable bottle fastener 15 is releasably secured to base 13 by inter connection of female Velcro strip 45 and male Velcro strip 49.

Referring now to FIG. 1, the operation of feeding apparatus 11 of the present invention will now be described. In FIG. 1, infant 67 is shown placed face-up on a substantially planar feeding surface 65, such as a bed, with its torso 77 in a substantially prone position. The front 69 of torso 77 is facing upward, and sides 71, 73 of torso 77 are substantially perpendicular to planar feeding surface 65. As shown in FIG. 1, pillow 66 may be placed beneath the head of infant 67, although feeding apparatus 11 of the present invention will operate with or without pillow 66.

Base 13 is adapted to conform in shape to the front 69 and sides 71, 73 (side 73 is obscured in FIG. 1) of the torso 77 of infant 67 during bottle feeding when the infant is placed prone and face-up on feeding surface 65. Center section 17 is placed across front 69 of torso 77 of infant 67 during feeding. First anchor section 19 is placed along side 71 of infant 67 at an angle with planar feeding surface 65. This angle may be characterized as "substantially perpendicular," although it may vary from normal by as much as forty degrees. When first anchor section 19 is in this position, heavy mobile particles 37 are substantially accumulated by force of gravity at lower region 41 of central compartment 37. Likewise, second anchor section 21 is placed along side 73 of infant 67 at an angle with planar feeding surface 65 to substantially accumulate heavy mobile particles 39 at lower region 43 of compartment 33. Since first and second anchor sections 19, 21 are axially aligned with center section 17, they operate to secure center section 17 in position across front 69 of the torso 77 of infant 67, to minimize side-to-side movement thereof while also minimizing the amount of weight placed on the infant's torso during feeding.

Bottle 75 is placed in clearance 63 between male Velcro strip 49 and cushion 47 of detachable bottle fastener 15. Filler material 61 of cushion 47 is compressed to accommodate bottle 75, and thereafter applies pressure to bottle 75 to keep it disposed within clearance 63. Male Velcro strip 49 of detachable bottle fastener 15 is then aligned with and secured to female Velcro strip 45 of base 13. Therefore, bottle 75 is secured to base 13 in a position transverse to the base, and aligned with torso 77 of infant 67, and within the infant's reach.

Feeding apparatus 11 of the present invention places bottle 75 within the reach of infant 67, allowing the infant some control over the bottle. More particularly, base 13 of fitting apparatus 11 serves to minimize side-to-side movement of bottle 75, but does not significantly inhibit forward and rearward movement of bottle 75 relative to infant 67. This feature allows the infant to bring bottle 75 forward for feeding, and push bottle 75 rearward for resting between intervals of feeding.

Subsequent to feeding, base 13 of feeding apparatus 11 may be used to aid in the burping of infant 67. With reference now to FIG. 5, the use of base 13 in this manner will now be described. Center section 17 is placed between front 69 of torso 77 of infant 67 and front side 83 of the shoulder 81 of the infant handler 79. Filler material 35 serves as a cushion for the infant's torso 77. First anchor section 19 is draped over shoulder 81 and partially disposed along back side 85 of shoulder 81. Second anchor section 21 is draped downward along front side 83 of shoulder 81. Mobile particles 37 of first anchor section 19 are urged downward by force of gravity into lower region 41 of compartment 31. Likewise, mobile particles 39 are urged downward by force of gravity into lower region 43 of compartment 33 of second anchor section 21 of feeding apparatus 11. Therefore, first and second anchor sections 19, 21 cooperate to secure base 13 about the handler's shoulder to minimize sliding of the base along the front and back of the handler's shoulder 81 during burping. Since base 13 is formed of substantially waterproof material, first anchor section 19 serves as a shield for the handler's shoulder during burping, to prevent damage to the handler's clothing from the spittle and vomit of infant 67.

With reference now to FIG. 1, detachable bottle fastener 15 is shown with a face 59 provided on one surface of cushion 47. This allows detachable bottle fastener 15 to operate as both a bottle fastener, and a toy for entertaining the infant during feeding. The feeding apparatus 11 of the present invention is adapted to maximize the infant's comfort and therefore foster feeding by the infant. The infant's comfort is enhanced since center section 17 serves as a cushion for bottle 75, as well as thermal shield. Therefore, the infant is less likely to feel the discomfort from the heat or weight of bottle 75. Additionally, center section 17 and cushion 47 cooperate to thermally shield bottle 75 and inhibit cooling of the formula contained therein. This is a desirable feature since infants usually prefer a formula that is warm to one that is cold.

The feeding apparatus of the present invention has a plurality of advantages over existing systems. It anchors the bottle in position on the infant's chest, and prevents side-to-side movement of the bottle, while keeping the bottle within range of the infant and allowing the infant some control over the position of the bottle. The feeding apparatus of the present invention also minimizes the amount of weight placed on the infant's chest during feeding. The center cushion section of the feeding apparatus cushions the weight of the bottle, and provides a thermal shield from the warm bottle. The detachable bottle fastener can be fashioned as a toy for entertaining the infant during feeding. It is releasable from the base of the feeding apparatus, to allow the base to be used as a aid for burping the infant. When used as a burping aid, the first and second anchor sections stabilize the cushion in position on the handler's shoulder and shield the handler's shoulder from the infants spittle and vomit.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An apparatus for aiding feeding of an infant while the infant is placed face-up on a substantially planar feeding surface with its torso in a substantially prone position, said torso defined in-part by a front and two sides comprising in combination:

a baby bottle;

a center section for placement across the front of the torso of the infant during feeding;

a first anchor section having two ends, coupled to said center section at one end and weighted at the opposite end for placement along one side of the torso of the infant during feeding;

a second anchor section having two ends, coupled at one end to said center section opposite from and axially aligned with said first anchor section and weighted at the opposite end for placement along the opposite side of the torso of the infant during feeding, wherein said first and second anchor sections cooperate to anchor the apparatus to said feeding surface, to secure said center section in position across the front of the torso of the infant, and to minimize side-to-side movement thereof, while minimizing the amount of weight placed on the infant's torso; and means for securing said baby bottle to said center section in a position aligned with the infant's torso, said means for securing comprising a cushion substantially filled with lightweight, compressible, resilient filler material, fastener means being located on one side of said cushion which engages cooperating fastener means on said center section, so as to secure said bottle between said cushion and said center section.

2. An apparatus for aiding feeding of an infant while the infant is placed face-up on a substantially planar feeding surface with its torso in a substantially prone position according to claim 1 wherein said center section comprises a cushion substantially filled with lightweight compressible resilient filler material for providing cushioning and thermal insulation between said bottle and the infant's torso.

3. An apparatus for aiding feeding of an infant while the infant is placed face-up on a substantially planar feeding surface with its torso in a substantially prone position according to claim 1 wherein said means for securing includes a toy for entertaining the infant during feeding.

4. An apparatus for aiding feeding of an infant with a baby bottle while the infant is placed face-up on a substantially planar feeding surface with its torso in a substantially prone position, said torso defined in-part by a front and two sides, comprising:

base adapted to conform in shape to the front and sides of the torso of the infant during bottle feeding when the infant is placed prone and face-up on said feeding surface, including:

(a) a center section for placement across the front of the torso of the infant during feeding;

(b) a flexible first anchor section coupled to said center section, and having a hollow central compartment filled in-part with heavy mobile particles, for placement along the side of the torso of the infant at an angle with said feeding surface during feeding with said heavy mobile particles substantially accumulated by force of gravity at a lower region of said compartment;

(c) a flexible second anchor section coupled to said center section opposite from and axially aligned with said first anchor section, having a hollow central compartment filled in-part with heavy mobile particles, for placement along the side of the torso of the infant at an angle with said feeding surface during feeding with said heavy mobile particles substantially accumulated by force of gravity at a lower region of said central compartment, wherein said first and second anchor sections cooperate to anchor the apparatus to said feeding surface, to secure said center section in position across the torso of the infant, and to minimize side-to-side movement thereof, while minimizing the amount of weight placed on the infant's torso;

a cushion substantially filled with lightweight, compressible, resilient filler material;

a strap having an inner surface, an outer surface, and two ends, secured at each end to said cushion but unconnected to said cushion between said ends, wherein a clearance is provided between said strap and said cushion, said clearance being adapted in size to accommodate said bottle therebetween when said resilient filler material is compressed, and wherein said bottle is held in position between said strap and said cushion by pressure from said resilient filler material of said cushion; and means for releasably fastening said outer surface of said strap to said center section of said base.

5. An apparatus for aiding feeding of an infant while the infant is placed face-up on a substantially planar feeding surface with its torso in a substantially prone position according to claim 4 wherein said apparatus minimizes side-to-side movement of said bottle relative to the infant but allows the infant some control over said bottle in the direction traverse to said base so the infant may selectively bring the bottle forward for feeding and rearward for resting.

6. An apparatus for aiding feeding of an infant while said infant is placed face-up on a substantially planar feeding surface with its torso in a substantially prone position according to claim 4 wherein said means for securing is releasable from said base.

7. An apparatus for aiding feeding of an infant while said infant is placed face-up on a substantially planar feeding surface with its torso in a substantially prone position according to claim 4 wherein said center section comprises a cushion substantially filled with lightweight compressible resilient filler material for providing cushioning and thermal insulation between said bottle and the infant's torso.

8. An apparatus for aiding feeding of an infant while said infant is placed face-up on a substantially planar feeding surface with its torso in a substantially prone position according to claim 4 wherein said center section, and first and second anchor sections are integrally formed.

9. An apparatus for aiding feeding of an infant while said infant is placed face-up on a substantially planar feeding surface with its torso in a substantially prone position according to claim 4 wherein said base is formed of substantially waterproof material.

10. An apparatus for aiding feeding of an infant while said infant is placed face-up on a substantially planar feeding surface with its torso in a substantially prone position according to claim 4 wherein said means for securing includes a toy for entertaining the infant during feeding.

11. A dual purpose apparatus for aiding in bottle feeding an infant while the infant is placed face-up on a substantially planar feeding surface with its torso in a substantially prone position, said torso defined in-part by a front and two sides, and for aiding in burping an infant while the infant is held upright by a handler against the front of the handler's shoulder with its face aligned over the back of the handler's shoulder, comprising:

base adapted to conform in shape to the front and sides of the torso of the infant during bottle feeding when the infant is placed prone and face-up on said feeding surface, and adapted to conform in shape to the handler's shoulder during the burping of the infant while the infant is held upright by the handler with its face aligned over the handler's shoulder, including:

(a) a center cushion section substantially filled with lightweight compressible resilient filler material for placement across the front of the torso of the infant during feeding, and for placement between the front of the torso of the infant and the shoulder of the handler during burping;

(b) a flexible first anchor section coupled to said center cushion section, and having a hollow central cavity filled in-part with heavy mobile particles, for placement along one side of the torso of the infant substantially perpendicular to said feeding surface during feeding with said heavy mobile particles substantially accumulated by force of gravity at a lower region of said central compartment, and for placement against the back of the handler's shoulder during burping with said heavy mobile particles substantially accumulated by force of gravity at a lower region of said central compartment;

(c) a flexible second anchor section coupled to said center cushion section opposite said first anchor section and axially aligned with said first anchor section, having a hollow central compartment filled in-part with heavy mobile particles, for placement along the opposite side of the torso of the infant and substantially perpendicular to said feeding surface during feeding with said heavy mobile particles substantially accumulated by force of gravity at a lower region of said central compartment, and for placement along the front of the shoulder of the handler substantially aligned with said center cushion section during burping, wherein said first and second anchor sections cooperate to anchor said base to said feeding surface, secure said center cushion section in position across the torso of the infant, and minimize side-to-side movement thereof while minimizing the amount of weight placed on the infant's torso during feeding, and wherein said first and second anchor sections cooperate to secure said base about the handler's shoulder to minimize sliding of the base along the front and back of the handler's shoulder during burping;

a cushion substantially filled with lightweight, compressible, resilient filler material;

a strap having an inner surface, an outer surface, and two ends, secured at each end to said cushion but unconnected to said cushion between said ends, wherein a clearance is provided between said strap and said cushion, said clearance being adapted in size to accommodate said bottle therebetween when said resilient filler material is compressed, and wherein said bottle is held in position between said strap and said cushion by pressure from said resilient filler material of said cushion;

means for releasably fastening said outer surface of said strap to said center section of said base; and wherein said base minimizes side-to-side movement of said bottle during feeding, and wherein said means for securing is releasably fastened to said base for use in feeding and is removed from said base prior to use in burping.

12. A dual purpose apparatus for aiding in bottle feeding an infant while said infant is placed face-up on a substantially planar feeding surface with its torso in a substantially prone position, and for aiding in burping an infant while said infant is held upright by a handler against the front of the handler's shoulder with its face aligned over the back of the handler's shoulder according to claim 11 wherein said base is formed of substantially waterproof material to shield the handler's shoulder during burping.

* * * * *